United States Patent [19]

Oliphant

[11] Patent Number: 4,658,970

[45] Date of Patent: Apr. 21, 1987

[54] DEFLECTION REDUCTION MODULE FOR BOOM HOIST CYLINDER OF MOBILE CRANE

[75] Inventor: Larry J. Oliphant, Swisher, Iowa

[73] Assignee: Kobe Steel Ltd., Kobe, Japan

[21] Appl. No.: 798,572

[22] Filed: Nov. 15, 1985

[51] Int. Cl.[4] ..... B66C 23/26

[52] U.S. Cl. ..... 212/182; 212/191; 212/238; 212/261; 188/379; 267/136; 414/719

[58] Field of Search ..... 212/191, 238, 261, 182, 212/266, 271; 92/9; 244/104 FP; 414/719, 720; 188/379 R, 380; 267/64.12, 64.13, 8 R, 140.1, 136

[56] References Cited

U.S. PATENT DOCUMENTS

| | | | |
|---|---|---|---|
| 2,838,140 | 6/1958 | Rasmusson et al. | 92/9 |
| 3,193,055 | 7/1965 | Morin | 92/9 |
| 3,426,651 | 2/1969 | Arendarski | 92/26 |
| 4,004,762 | 1/1977 | Jenkins | 244/104 FP |
| 4,088,286 | 5/1978 | Masclet et al. | 244/104 FP |
| 4,573,592 | 3/1986 | Oliphant | 212/182 |

*Primary Examiner*—Joseph F. Peters, Jr.
*Assistant Examiner*—Thomas J. Brahan
*Attorney, Agent, or Firm*—James E. Nilles; Thomas F. Kirby

[57] ABSTRACT

A mobile crane comprises a vehicle chassis mounted on balloon tires, a crane boom pivotally mounted on the chassis, and a double-acting boom hoist cylinder connected between the chassis and the boom for raising and lowering the boom. As the mobile crane traverses rough terrain or accelerates or decelerates, its mass causes the chassis to deflect (bounce or porpoise) relative to the terrain. A deflection reduction system, which presupposes that the boom is unrestrained and free to pivot (deflect) relative to the chassis, comprises a deflection reduction module mechanically mounted on the outside of the boom hoist cylinder and selectively operable valves for hydraulically connecting the module thereto. The module comprises a gas barrel containing compressed gas, a gas piston slidably mounted therein, a hydraulic fluid barrel axially aligned with the gas barrel, a hydraulic fluid piston (of smaller area than the gas piston) slidably mounted therein and connected to the gas piston, and a helical compression spring in the gas barrel for biasing the pistons in the same direction as the compressed gas. Operation of a first solenoid valve mounted on the outside of the boom hoist cylinder isolates the double-acting boom hoist cylinder and interconnects its opposite ends in a closed circuit. Simultaneous operation of a second solenoid valve mounted on the outside of the module connects the closed circuit to a fluid inlet/outlet port in the hydraulic fluid barrel. As a result, boom deflection causes hydraulic fluid flow into and out of the hydraulic fluid barrel. The resulting reaction of the spring and the compressed gas reduces deflection of the chassis.

22 Claims, 12 Drawing Figures

DEFLECTION REDUCTION MODULE FOR BOOM HOIST CYLINDER OF MOBILE CRANE

BACKGROUND OF THE INVENTION

1. Field of Use

This application relates to and is co-pending with U.S. patent application Ser. No. 732,891, filed May 8, 1985, by Larry J. Oliphant and entitled "MEANS TO REDUCE OSCILLATORY DEFLECTION OF VEHICLE" and which was allowed on Sept. 4, 1985. This application also relates to and is co-pending with U.S. patent application Ser. No. filed 798,333, filed Nov. 15, 1985, by Larry J. Oliphant and entitled "CONTROL FOR DEFLECTION REDUCTION MEANS", which is a divisional of Ser. No. 732,891 now U.S. Pat. No. 4,573,592. The two aforementioned applications and the instant application are by the same inventor and are assigned to the same assignee.

This invention relates generally to vehicles, such as mobile cranes or the like, which have a load-handling boom pivotably mounted on the vehicle chassis. In particular, it relates to a deflection reduction system for reducing or preventing bouncing or porpoising of the chassis as the vehicle moves across terrain. More specifically, it relates to such a system which employs a deflection reduction module which is mechanically mountable on a boom hoist cylinder on the vehicle and to valve means for hydraulically connecting the module to the boom hoist cylinder.

2. Description of the Prior Art

As explained in the aforesaid U.S. patent applications and hereinafter, in vehicles of the aforesaid type the chassis is supported on resiliently compressible balloon tires and may also employ axle springs. When the vehicle is to be moved between job sites, the boom, which is pivotably mounted on the chassis and can be raised and lowered by a boom hoist cylinder, is lowered and rigidly secured to the chassis in road-transport position. As the vehicle moves across rough terrain or accelerates or decelerates rapidly, the heavy mass of the vehicle tends to generate dynamic loads on the vehicle axles which cause the chassis to oscillate or deflect angularly and vertically (i.e., bounce or "porpoise") relative to the terrain over which it travels. This is a dangerous condition. The aforementioned allowed U.S. patent application Ser. No. 732,891 discloses deflection reduction means for reducing or eliminating such chassis deflection. Such deflection reduction means presupposes that the boom is unrestrained and free to pivot (i.e., deflect) relative to the chassis and comprises components which are embodied in a double-acting boom hoist cylinder, namely, a resiliently compressible and expandable spring effectively connected between the boom and chassis and clamping means (also effectively connected between the boom and chassis and in the form of a volume of compressed gas to reduce the speed of spring motion as rapidly as possible to thereby dissipate the dynamic loads. Such deflection reduction means also comprises suitable valve means to bring the said components into play when needed. Such deflection reduction means, being embodied in the boom hoist cylinder, require a boom hoist cylinder of special construction.

SUMMARY OF THE PRESENT INVENTION

In accordance with the present invention, there is provided an improved deflection reduction system which employs a deflection reduction module which is mechanically mountable on the exterior of a boom hoist cylinder and which employs valve means for hydraulically connecting the module to the boom hoist cylinder.

The invention is adopted for use on a vehicle, such as a mobile crane or the like, which comprises a vehicle chassis mounted on balloon tires (with or without axle springs), a load-handling boom pivotably mounted on the chassis for movement in a vertical plane, and a double-acting boom hoist cylinder operable for raising and lowering the boom during boom hoisting operations and connected between the chassis and the boom. More specifically, the boom hoist cylinder comprises a boom hoist cylinder housing which has a boom hoist piston slidably mounted therein and a boom hoist piston rod connected to the boom hoist piston and extending from an end of the boom hoist cylinder housing. The boom hoist cylinder housing is pivotably connected to the chassis and the boom hoist piston rod is pivotably connected to the boom. The boom hoist piston divides the boom hoist cylinder housing into two hydraulic fluid chambers at opposite ends thereof. The vehicle is of a type, therefore, in which the chassis tends to deflect (bounce or porpoise) relative to the terrain over which it travels, if the boom is fixedly secured to the chassis during road transport. As the vehicle tranverses rough terrain or accelerates or decelerates the chassis to deflect (bounce or porpoise) relative to the terrain.

The deflection reduction system is provided to reduce such deflection and presupposes that the boom is unrestrained and free to pivot (deflect) relative to the chassis. The system comprises a deflection reduction module mechanically mounted on the exterior of the boom hoist cylinder and selectively operable valve means for hydraulically connecting the module to the boom hoist cylinder. The deflection reduction module operates in response to dynamic loads on the boom to reduce or eliminate deflection (bouncing or porpoising) of the vehicle chassis as the mobile crane travels across various types of terrain or accelerates or decelerates. The module comprises a housing attached to the boom hoist cylinder, a gas barrel or cylinder in the housing containing compressed gas and having a gas piston slidably mounted therein, a hydraulic fluid barrel or cylinder in the housing (axially aligned with the gas barrel) and having a hydraulic fluid piston (of smaller area than the gas piston) slidably mounted therein, a hydraulic fluid inlet/outlet port in the hydraulic fluid barrel, a module piston rod interconnecting the two pistons so that they move in unison, and a helical compression spring mounted in the gas barrel for biasing the pistons in a given direction (i.e., the same direction that the compressed gas biases the gas piston). The compression spring is mounted in a gas barrel between the gas piston and the housing wall at the end of the gas barrel and is disposed on a spring support on the gas piston.

A hydraulic control system is provided for operating the boom hoist cylinder in a conventional manner and comprises a three-position boom hoist control valve for raising and lowering the boom, and a holding valve to maintain the boom in a selected raised position when it is not being raised or lowered.

The selectively operable valve means for hydraulically connecting the module to the boom hoist cylinder comprises first and second solenoid operated check valves and a pressure responsive shuttle valve. To activate the deflection reduction system, the first solenoid valve is operated to isolate the boom hoist cylinder from the hydraulic control system by which it is raised and lowered and to interconnect the opposite end chambers of the double-acting boom hoist cylinder into a closed hydraulic circuit. Simultaneously, the second solenoid valve (preferably mounted on the module) is operated to connect the closed hydraulic circuit to the fluid inlet/outlet port in the hydraulic fluid barrel. As a result, deflection of the boom relative to the chassis while the vehicle is in motion causes hydraulic fluid flow between the boom hoist cylinder and the hydraulic fluid barrel and the reaction of the spring and the compressed gas causes reduction in the deflection of the vehicle chassis relative to the terrain.

More specifically, the first check valve is selectively operable to connect the inlet/outlet port (located on one side of the hydraulic fluid piston) to both of the boom hoist cylinder chambers on opposite sides of the boom hoist piston. Deflection of the boom relative to the vehicle chassis while the vehicle is in motion forces hydraulic fluid into or out of the hydraulic fluid barrel and corresponding sliding motion of the piston assembly (which comprises the hydraulic piston, gas piston and module piston rod) causes compression or decompression of the spring and gas. The compression/-decompression of the gas effects damping of the spring motion and reduction of deflection of the chassis relative to the terrain.

A second solenoid-operated check valve (operable simultaneously with the first such valve) is provided. The second solenoid-operated check valve and shuttle valve operate to bypass the boom hoist control valve and to interconnect both ends of the boom hoist cylinder into a closed system whenever the first solenoid-operated check valve is operated to hydraulically connect the deflection reduction module to the closed system.

The deflection reduction system in accordance with the present invention offers several advantages. For example, it is applicable to existing vehicles having conventional boom hoist cylinders and conventional hydraulic control systems therefor. It does not require a boom hoist cylinder of special design or construction and, thereby, reduces costs. It functions as well as a built-in deflection reduction means and makes the safety advantages available to a wide variety of vehicles having load-handling booms of various types and which would otherwise porpoise dangerously when operated over-the-road. The module is relatively simple in design, construction and mode of operation and is easy and economical to manufacture and install. The valve means in the system include solenoid valves which are easily and conveniently mounted on the module itself and on the exterior of the boom hoist cylinder. The design of the module is such that barrels and pistons of suitable size can be readily fabricated or selected to accommodate boom hoist cylinders of various sizes. The means for supporting the compression spring within the gas cylinder ensures that it is always maintained in proper position and cannot jam, while at the same time ensuring that gas cylinder volume is sufficiently large to ensure proper functioning of the system. Other objects and advantages of the system will hereinafter appear.

DRAWINGS

DESCRIPTION OF A PREFERRED EMBODIMENT

Figure 1:
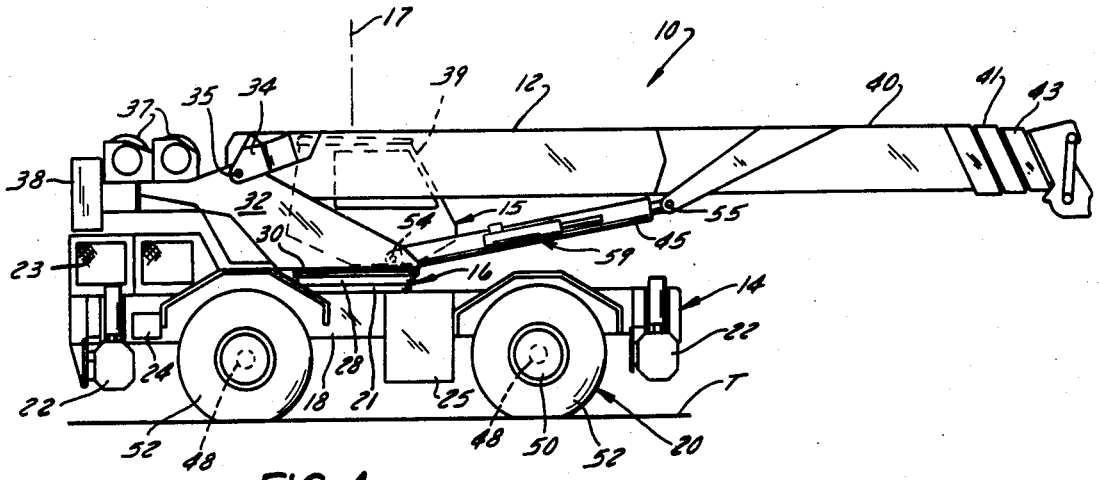
FIG. 1 is a side elevation view of a mobile crane embodying dynamic stabilization means in the form of a deflection reduction system in accordance with the present invention.
Figure 2:
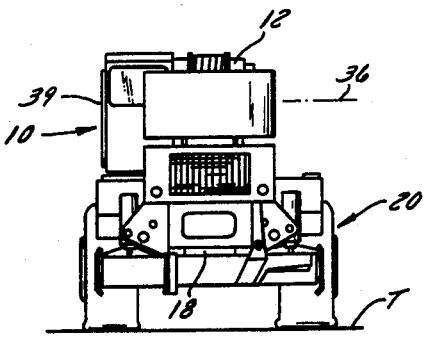
FIG. 2 is a rear end elevation view of the crane shown in FIG. 1.

Referring to FIGS. 1 and 2, the numeral 10 designates a self-propelled vehicle, such as a mobile crane, which carries a large heavy component 12 in the form of a telescopic crane boom exhibiting the characteristics of an integral mass mounted on a chassis 18 of the vehicle. Vehicle 10 embodies dynamic stabilization means in the form of a deflection reduction system in accordance with the present invention to overcome any tendency for the chassis 18 (and the heavy component 12 mounted thereon) to oscillate angularly or "porpoise" or bounce relative to the terrain T over which the vehicle travels in response to dynamic loads resulting from terrain roughness or from rapid acceleration or deceleration of the vehicle 10. Vehicle 10 generally comprises a lower section 14 on which an upper section 15 is mounted by means of a slew ring assembly 16 for rotation in either direction to an unlimited degree about a vertical axis 17 during crane operation.

Lower section 14 comprises a chassis 18 on which are mounted four wheel assemblies such as 20, a fixed ring 21 of the aforesaid slew ring assembly 16, four extendible outriggers such as 22 for deployment during crane operation, a source of power 23 such as an internal combustion engine for providing operating power to the crane and for providing motive power for the wheel assemblies 20, an electric battery 24 for starting the engine 23, and a hydraulic fluid reservoir 25 for supplying operating fluid to certain vehicle and crane components.

Upper section 15 comprises a rotatable ring 28 of the aforesaid slew ring assembly 16 and a support frame 30 which is rigidly secured to ring 28. A boom support assembly 32 is rigidly mounted on support frame 30 and telescopic boom 12 is mounted by means of a pivot assembly 34, including a pivot pin 35, on support frame 30 for pivotal movement between raised and lowered positions about a horizontal axis 36 during crane operation. Telescopic boom 12 includes a base boom section 40, an inner boom section 41 telescopable within the base boom section, an outer boom section 42 telescopable within the inner boom section, and at least one hydraulic ram (not shown) for effecting extension and retraction of boom sections 41 and 42. Support frame 30 also affords support for two cable winches such as 37, a counterweight 38 and an operator's cab 39.

A pair of boom hoist cylinders such as 45, hereinafter described in detail, are each connected between boom support assembly 30 and base boom section 40 to raise and lower the telescopic boom 12 and each cylinder 45 also carries a deflection reduction module 59 and valve means -and- therefore which are part of the deflection reduction system in accordance with the invention, as hereinafter explained.

Each wheel assembly 20 for chassis 18 of lower section 14 of vehicle 10 includes an axle 48, a wheel 50 rotatably mounted on the axle, and a resilient large inflated balloon tire 52 mounted on the wheel and engageable with the terrain T indicated in FIGS. 1 through 4, which may be a road surface or earth surface over which vehicle 10 is movable. In the embodiment shown in the drawings, axle 48 is secured to chassis 18 in such a manner that, while rotating and steering movement of the axle 48 may be possible, relative vertical motion between the axle 48 and the chassis 18 is not possible. However, the large inflated balloon tire 52 is resiliently compressible vertically downward to a certain extent in response to vertical loads imposed downwardly by the upper and lower sections 14 and 15, respectively, of vehicle 10. Tire 52 is also resiliently decompressible vertically upward in response to relieving of such a vertical load. As a result, the tire 52 serves as a resilient support means for chassis 18 and chassis 18 is resiliently movable vertically and angularly, both upwardly and downwardly in the direction of arrow A and angularly in the direction of arrow B shown in FIG. 3 relative to the terrain T as the vehicle 10 moves thereacross, as hereinafter explained.

In the embodiment shown, vehicle 10 is self-propelled and one or more axles 48 are adapted to be rotatably driven by engine 23 by suitable drive and power transmission means (not shown) to propel the vehicle 10. Furthermore, either two or four of the axles 48 are steerably movable by suitable steering means (not shown) to enable vehicle 10 to be steered while being driven. However, it is to be understood that the present invention can be employed in a type of mobile crane which is mounted on a trailer type vehicle (not shown) which is not self-propelled but is adapted to be towed by another vehicle such as a truck (not shown). Furthermore, instead of relying solely on resilient tires 52 to enable relative vertical movement between chassis 18 and the terrain T, each axle 48 could be connected or secured to chassis 18 by a conventional axle spring (not shown) with or without conventional axle spring shock absorber (not shown) associated therewith to serve as another form of resilient support means for chassis 18 and to enable relative vertical motion between chassis 18 and the terrain T.

The pair of boom hoist cylinders such as 45 are operable to pivotably raise and lower telescopic boom 12 vertically about pivot pin 35. Each boom hoist cylinder 45 is connected at its lower end by a lower pivot pin 54 to a point P1 (see FIGS. 1 and 4) on boom support assembly 32 (and thus on chassis 18) and at its upper end by an upper pivot pin 55 to a point P2 (see FIGS. 1 and 4) on boom base boom section 40. As hereinafter explained, each boom hoist cylinder 45 also supports the deflection reduction module 59 and valve means -and-therefor in accordance with the invention.

Operator's cab 39 houses certain control levers and switches, hereinafter identified, for actuating the deflection reduction system, as well as conventional controls for driving and steering the vehicle 10, for operating the crane upper section 15 and the crane boom 12 and for operating the outriggers 22.

Figure 3:
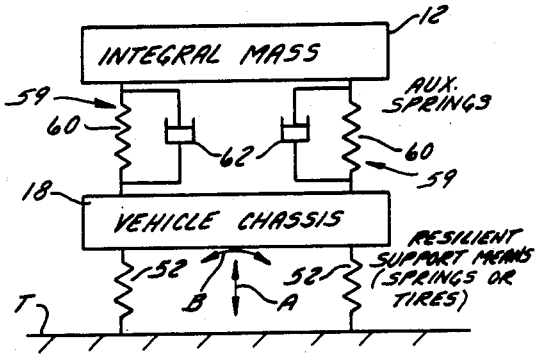
FIG. 3 is an elementary schematic diagram of certain components of the crane of FIGS. 1 and 2.

As FIGS. 3, 4, 5 and 8 show, module 59 generally comprises at least one load-bearing auxiliary spring 60 (a pair of which are shown in FIG. 3) effectively connected between the chassis 18 and the boom or component 12 to resist vertical and angular deflections therebetween, and damping means 62, including a gas barrel 104 having a gas chamber 105 therein and a gas piston 109 therein in parallel with spring 60 to dampen the motion of the spring. In the embodiment of the invention disclosed herein, FIGS. 1, 6 and 7 show a load-bearing spring 60 and damping means 62 are economically and embodied in module 59 which is mounted on the outside of boom hoist cylinder 45 which is provided for raising and lowering the boom 12.

Before providing a detailed explanation of the construction of the deflection reduction system, its operation should be generally understood. In accordance with the invention the component, such as a boom 12, instead of being rigidly and immovably secured to the vehicle chassis 18 during road transport as the conventional practice, is allowed to swivel, pivot or deflect angularly about the horizontal pivot axis of pin 35 in the pivot assembly 34 as the vehicle 10 tends to bounce or porpoise as it is propelled over the terrain T. However, this angular motion of boom 12 is controlled by the aforesaid spring 60 and damping means 62. The system is found to provide optimum results when the rate of spring force as spring 60 expands and contracts and the rate of damping force of the damping means 62 (filled with compressed gas), as well as the relative positions of the pivot axis of pin 35, spring 60, and other components are chosen so that a load or force input on the vehicle axles 48 is dissipated as heat at the fastest possible rate. The pivot axis of pin 35 and spring locations of spring 60, as well as spring and damping characteristics, are chosen or determined so that the previously uncontrolled natural modes of oscillation of chassis 18 are replaced with natural modes which are dynamically coupled to movement of the suspended mass or boom 12. The vibrational amplitude of the chassis in any of its natural modes can then be controlled by adding damping means 62 to the auxiliary spring 60.

Figure 5:
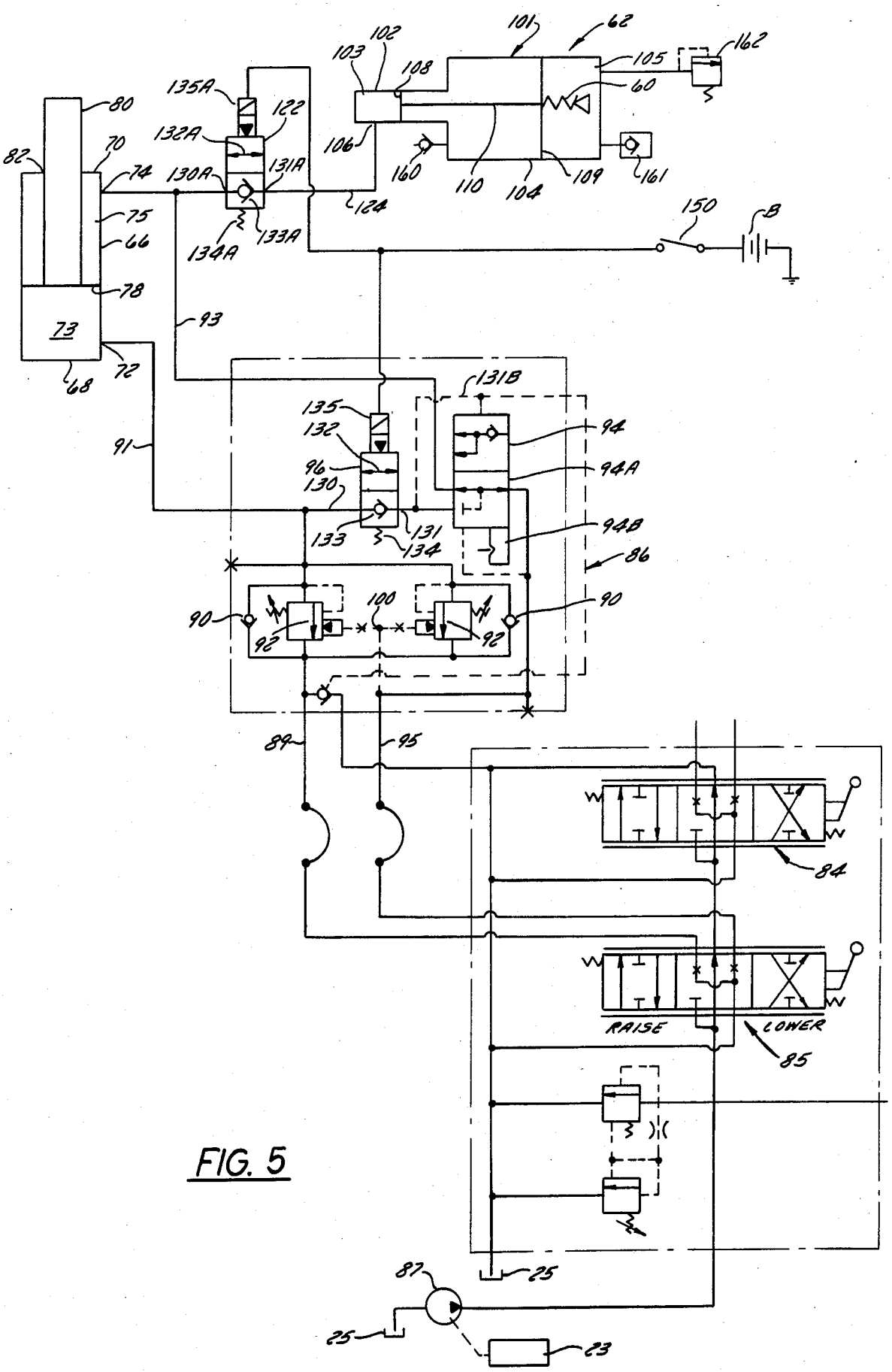
FIG. 5 is a simplified cross-section view of a boom hoist cylinder for the crane boom shown in FIGS. 1 and 2, a simplified cross-section view of a deflection reduction module and a schematic diagram of a hydraulic control circuit therefor, in accordance with the invention.
Figure 7:
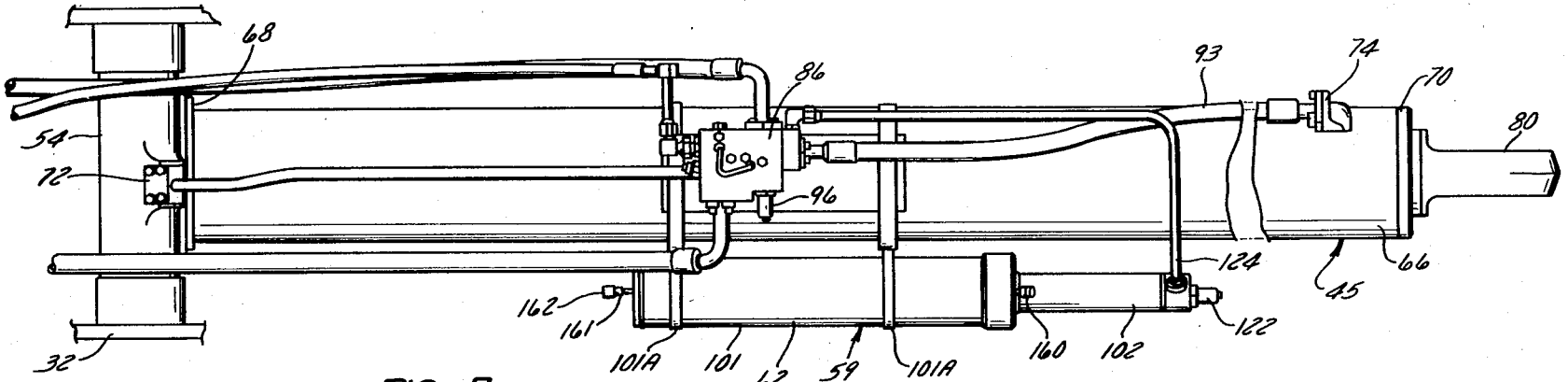
FIG. 7 is a top plan view of the boom hoist cylinder and module shown in FIG. 6.
Figure 6:
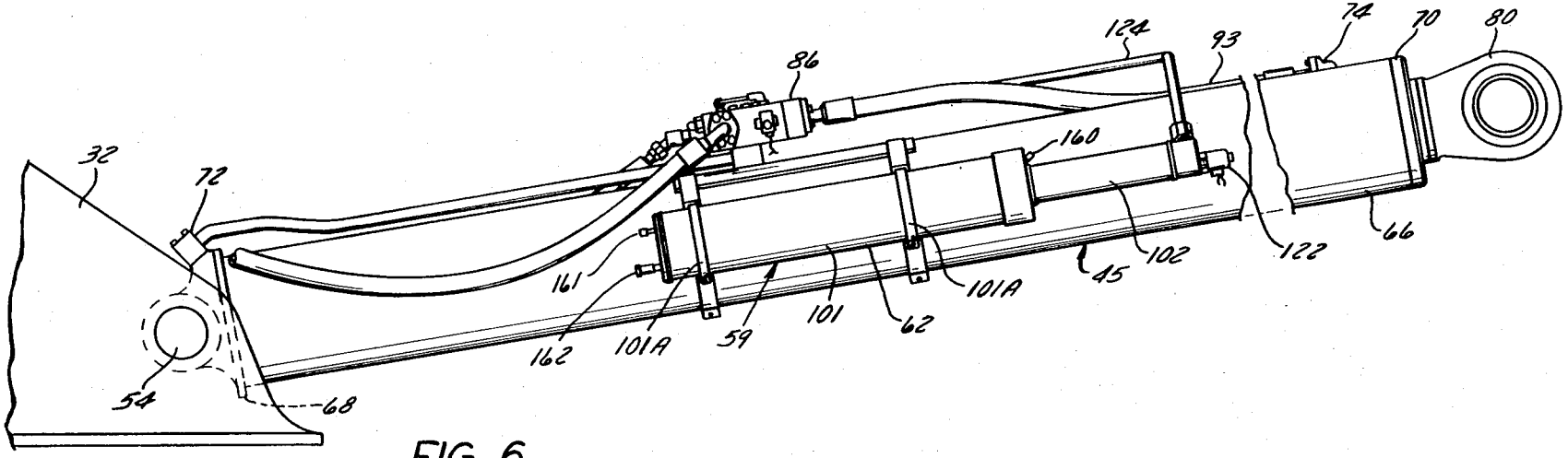
FIG. 6 is a side elevation view of the boom hoist cylinder with the deflection reduction module mounted thereon.
Figure 8:
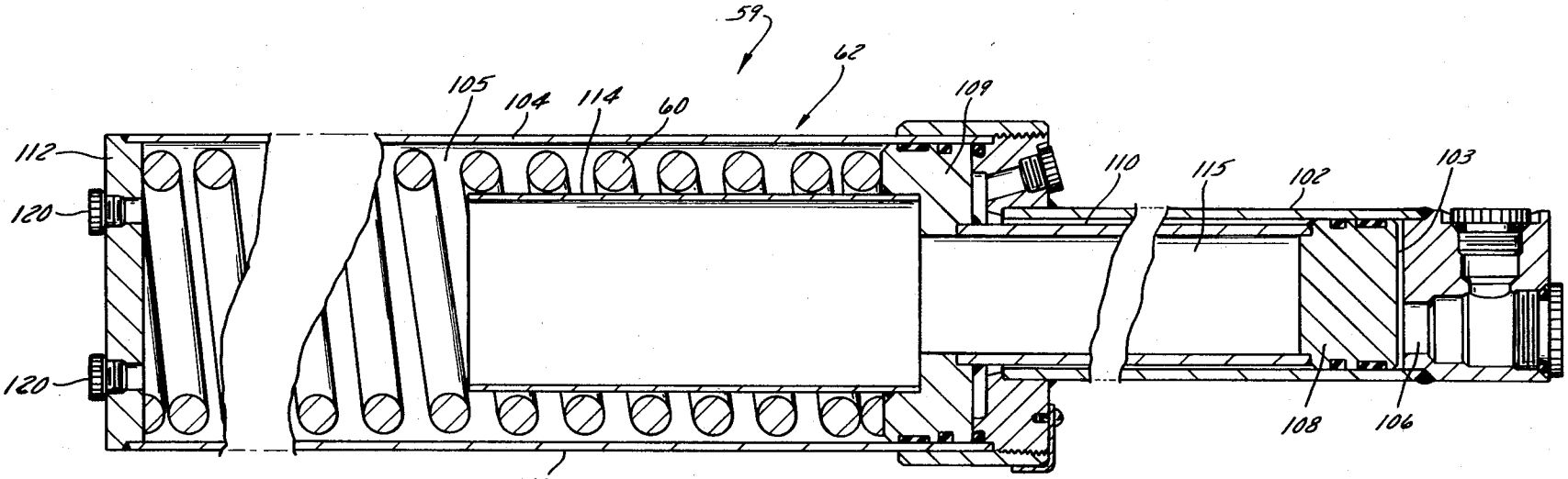
FIG. 8 is an enlarged more complete cross-section view of the module shown in FIGS. 1, 5, 6 and 7.
Figure 10:
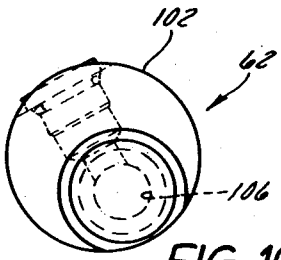
FIG. 10 is an end view of the hydraulic fluid barrel of the module shown in FIG. 8.
Figure 9:
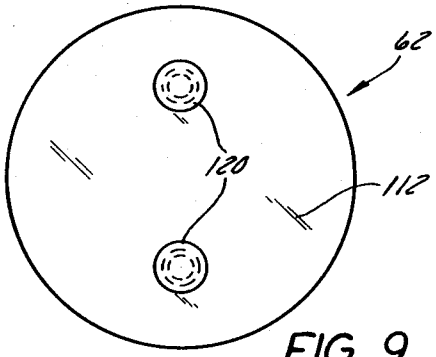
FIG. 9 is an end view of the gas barrel of the module shown in FIG. 8.

Referring now to FIGS. 5, 6 and 7, it is seen that a boom hoist cylinder 45 is constructed as follows. Cylinder 45 comprises a hollow cylinder 66 having an end cap 68 rigidly secured at one end and a piston rod seal 70 at and within its other end. End cap 68 comprises a fluid port 72 which communicates with one chamber 73 in cylinder 66. Cylinder 66 comprises a fluid port 74 which communicates with another chamber 75 in cylinder 66. The chambers 73 and 75 are separated by main piston 78 which is slidably mounted in the bore of cylinder 66. Main piston 78 is connected to a piston rod 80 which extends outwardly of the said other end of cylinder 66 through a hole 82 in piston rod seal 70.

When pressurized hydraulic fluid is supplied through port 72 to chamber 73 in cylinder 66, piston 78 and its attached rod 80 are shifted toward boom hoist cylinder extend position, boom 12 is raised, and fluid is exhausted from chamber 75 out through port 74. Conversely, when pressurized hydraulic fluid is supplied through port 74 to chamber 75 in cylinder 66, piston 78 and its attached rod 80 are shifted toward boom hoist cylinder retract position, boom 12 is lowered, and fluid is exhausted from chamber 73 out through port 72.

Boom hoist cylinder 45 as thus far described is operable to raise and lower the boom 12 in response to operation of a hydraulic boom hoist control system shown in FIG. 5. This control system comprises a manually operable, four-way, three-position (neutral, raise, lower), boom hoist directional control valve 85 for connecting the fluid ports 72 and 74 in cylinder 66 to a pump 87 or to the hydraulic reservoir 25. A manually operable boom telescope valve 84 is also provided to extend and retract telescopic boom 12, but is not directly pertinent to the present invention. The control system also comprises a valve assembly 86 (shown schematically in FIG. 5) which includes holding or counterbalancing valves 92, an integral detented shuttle valve 94 including a shiftable spool 94A and detent assembly 94B, a solenoid-operated first check valve 96, which is part of the deflection reduction system hereinafter described, and necessary interconnecting fluid lines or passages. When valve 85 is shifted from its neutral position (shown in FIG. 5) to its raised position, pump 87 (driven from engine 23) receives hydraulic fluid from reservoir 25 and supplies it under pressure through selector valve 85, through a fluid line 89, through the one-way check valves 90 portion of holding valves 92 and through a fluid line 91 to port 72 of cylinder 66 to effect boom hoist cylinder extension. At the same time exhaust fluid from port 74 of cylinder 66 flows through a fluid line 93, through a shuttle valve 94, through a fluid line 95 and through selector valve 85 back to reservoir 25.

When selector valve 85 is shifted from neutral position to its lower position, pump 87 receives hydraulic fluid from reservoir 25 and supplies it under pressure through control valve 85, through shuttle valve 94, and through fluid line 93 to port 74 of cylinder 66 to effect boom hoist cylinder retraction. At the same time exhaust fluid from port 72 of cylinder 66 flows through fluid line 91, through the holding valves 92 (which are shifted to open position when fluid line 95 is pressurized and supplies pilot pressure through a passage 100), through line 89 and through control valve 85 back to reservoir 25.

When selector valve 85 is in neutral position as shown in FIG. 5, the holding valves 92 remain in closed position as shown in FIG. 5 and prevent hydraulic fluid from being exhausted from boom hoist cylinder chamber 73 and thereby preventing unintentional retraction of the boom hoist cylinder 45 under the weight of the boom 12 and any load thereon.

As FIGS. 5 through 10 show, the dynamic stabilization means in the form of deflection reduction module 59 and its valve means are mounted on the exterior of boom hoist cylinder 45 and are constructed as follows.

Deflection reduction module 59 is adapted by straps 101A for mechanical connection to boom hoist cylinder 45 comprises a housing 101 including a barrel 102 containing a hydraulic fluid chamber 103 and a barrel 104 containing a compressed gas chamber 105. Gas chamber 105 has a transverse circular cross-sectional area larger than that of hydraulic fluid chamber 103. Housing 101 has a fluid inlet/outlet port 106 communicating with hydraulic fluid chamber 103. A piston assembly is mounted in housing 101 and comprises a hydraulic fluid piston 108 slidably mounted in hydraulic fluid chamber 103 and a gas piston 109 slidably mounted in gas chamber 105 and connected to and movable with hydraulic fluid piston 108 by means of a module piston rod 110. Gas piston 109 has an area larger than hydraulic fluid piston 103. In an actual embodiment gas piston 109 was about 5 inches in diameter and hydraulic fluid piston was about 2½ inches in diameter and piston assembly travel was about 9 inches. A helical compression spring 60 is mounted in gas chamber 105 between gas piston 109 and an end wall portion 112 of housing 101 near an end of gas chamber 105. A spring support member 114 is provided in gas chamber 105 and is connected to and extends from gas piston 109 and spring 60 is disposed therearound. Piston rod 110 extends between and into both chambers 103 and 105 and is connected to both pistons 108 and 109. Piston rod 110 has a hollow interior space 115 which is in communication with gas chamber 105 but is sealed from hydraulic fluid chamber 103 by piston 108. Spring support member 114 is a hollow tubular member open at both ends and serves as a means through which space 115 in piston rod 114 communicates with gas chamber 105. Housing 101 comprises sealable port means in the form of two plugs 120 in end wall portion 112 for filing gas chamber 105 with compressed gas, such as nitrogen. A solenoid-operated second check valve 120 is mounted on housing 101 for controlling hydraulic fluid flow through inlet/outlet port 106 and is part of the deflection reduction system. The compressed gas in gas chamber 104 biases gas piston 109 in one direction (rightward in FIG. 8). The pistons 108 and 109 are interconnected so that they are movable in unison. Spring 60 biases the pistons 108 and 109 in the same direction as the compressed gas.

As FIGS. 5, 6 and 7 show, module 59 has three valves 160, 161 and 162 mounted thereon. Valve 160 is a one-way check valve to vent to atmosphere any fluids which leak past the pistons 108 and 109 due to the high pressures involved. Valve 161 is a quick-disconnect one-way check valve which enables gas chamber 105 to be charged with pressurized gas when module 59 is to be initially placed in service or subsequently recharged. Valve 162 is a pressure relief valve which opens to vent to atmosphere in case gas chamber 105 is overcharged beyond a predetermined pressure with gas being supplied through valve 161.

The valve means which are part of the deflection reduction system are selectively operable to interconnect the opposite end chambers 73 and 75 of boom hoist cylinder 45 in a closed circuit including lines 91 and 93, check valve 96 and shuttle valve 94 and to connect said closed circuit to hydraulic fluid chamber 103 of module 59 through a fluid line 124.

The valve means comprises the second selectively operable solenoid-operated check valve 122. Valve 122 has one position wherein it enables hydraulic fluid flow in both directions through line 124 between said closed circuit and hydraulic fluid chamber 103 and has another position (shown in FIG. 5) wherein it operates as a check valve which prevents hydraulic fluid flow to hydraulic fluid chamber 103 but permits hydraulic fluid flow from hydraulic fluid chamber 103 to line 93.

The valve means further comprises the first selectively solenoid-operated check valve 96. Valve 96 has one position wherein it effects establishment of said closed circuit and another position (shown in FIG. 5) wherein it dis-establishes said closed circuit. The valves 96 and 122 are operated so that both assume the free flow position at the same time and so that both assume the check valve position at the same time. The valves 96 and 122 are operated substantially simultaneously. The shuttle valve 94 is responsive to operation of selectively operable valve 96 (by virtue of pilot pressure applied thereto through line 131A) to aid in establishing said closed circuit by moving from the position shown in FIG. 5 to its other position wherein it connects lines 91 and 93.

Referring again to FIG. 5, it is seen that the first solenoid-operated check valve 96 includes valve ports 130, 131, an internal passage 132, a one-way check valve 133, a biasing spring 134 which normally biases the check valve 133 between the ports 130 and 131, and a solenoid 135 energizable to shift passage 132 between the valve ports 130 and 131. Second solenoid-operated check valve 122 is similarly constructed and numerals designating corresponding ports bear the suffix "A". Energization and deenergization of the solenoids 135 and 135A are controlled by an electrical control circuit shown in simplified form in FIG. 5 and hereinafter described in detail. It is to be understood that the solenoids 135 and 135A are energized simultaneously to bring the deflection reduction system or stabilizer on boom hoist cylinder 45 into play after boom 12 has been lowered to a road transport position (which is about 10° above its lowest possible substantially horizontal position) by operation of the boom hoist operating or control valve 85 and the latter is then returned to its neutral position (see FIG. 5). Energization of solenoid 135 shifts passage 132 between the valve ports 130 and 131 and pilot pressure in line 131A causes the spool 94A in shuttle valve 94 to shift downward (with respect to FIG. 5) past detent 94B and establishes a closed hydraulic circuit as follows: from chamber 73 of cylinder 66 of boom hoist cylinder 45, through port 72, through line 91, through passage 132 in first solenoid check valve 96, through shuttle valve 94, through line 93, and through cylinder port 74 to chamber 75 in cylinder 66 of boom hoist cylinder 45. Energization of solenoid 135A shifts passage 132A between the valve ports 130A and 131A to establish a direct connection in line 124 allowing free flow of hydraulic fluid between line 93 of the closed hydraulic circuit (established by first valve 96, as above-described) and hydraulic fluid chambers 103 of module 59 through port 106. Consequently, if road or driving conditions affecting vehicle 10 tend to cause oscillatory angular deflection (up or down) of boom 12 about pivot pin 35 and relative to chassis 18, then hydraulic fluid in chambers 73 and 75, being trapped in the aforesaid closed hydraulic system, is forced through line 124 out of or into chamber 103 in module 59, depending on the direction of boom motion (up or down), and spring 60 and the compressed gas in chamber 105 in module 59 are able to decompress or to further compress, depending on the direction and extent of boom motion. The diameter of the pistons 108 and 109, the size of the chambers 103 and 105, the size of spring 60 and the static pressure of the compressed gas operate to control the rate of transfer or the rate of fluid flow in the closed hydraulic system and thereby assist in controlling the rate at which spring 60 the volume of gas can compress or decompress. This has the effect of damping or dissipating the motion or deflection of boom 12 relative to chassis 18 and the deflection of chassis 18 relative to the terrain.

Referring to FIG. 5, the simplified electrical control system for the solenoids 135 and 135A of valves 96 and 122 is seen to comprise a source of electrical power, such as a battery B, a normally open single pole single switch 150. A more elaborate electrical control circuit adaptable to control these two solenoids 135 and 135A so as to ensure that module 59 cannot be activated or engaged until boom 12 is in proper position is shown in U.S. patent application Ser. No. 732,891.

In operation, closure of switch 150 after proper placement of boom 12 (i.e., 10° from its lowermost position) energizes solenoids 135 and 135A and enables operation of the deflection reduction system as hereinbefore described.

Figure 4:
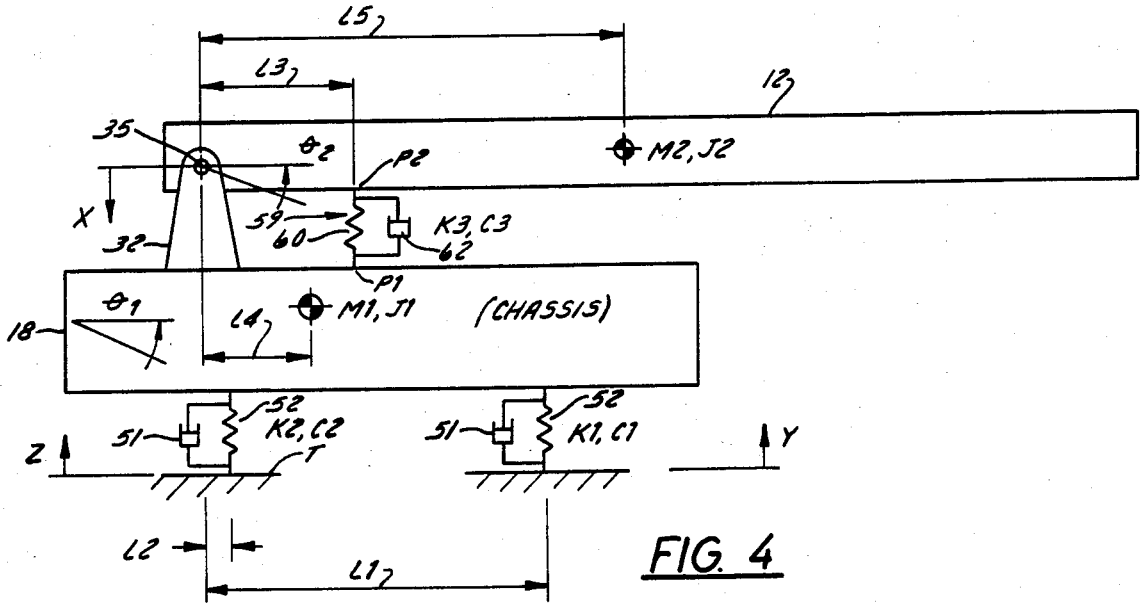
FIG. 4 is a more complex schematic diagram or mathematical model of certain components and physical relationships embodied in the crane of FIGS. 1 and 2.

Turning now to FIG. 4, there are depicted significant points, relationships and distances which enable the deflection reduction system or stabilization means in accordance with the invention to function at its optimum in accordance with the following matematical model using formulae of motion wherein distances are in feed and masses are in slugs, i.e., $$\frac{\text{Pounds}}{\text{Gravitational Acceleration (32.2)}}.$$

In the formulae:

L1 is the horizontal distance between the front wheel axle 48 and the boom pivot 35;

L2 is the horizontal distance between pin 35 and rear axle;

L3 is the distance between the axis of pivot pin 35 and the axial centerline of cylinder 45;

L4 is the horizontal distance between the axis of pivot pin 35 and the center of mass of chassis 18 and its appurtenances;

M1 is the mass of chassis 18 and its appurtenances;

J1 is the principal mass moment of inertia about an axis through the center of mass M1;

M2 is the mass of boom 12 and its appurtenances;

J2 is the principal mass moment of inertia about an axis through the center of mass M2;

O 1 is the deflection angle of the chassis 18;

0 2 is the deflection angle of boom 12;

K1, K2 and K3 are respective spring rates in pounds per foot;

C1, C2 and C3 are damping rates in pounds x seconds/per foot;

X, Y and Z represent vertical deflections and the associated arrows show the direction.

In the following mathematical model or formulae for equations of motion:

ΣF is the summation of forces;

ΣM1 is the summation of moments for the rotation of mass M1 about the boom base pivot pin; and ΣM2 is the summation of moments for the rotation of mass M2 about the boom base pivot pin.

Thus:

$$\Sigma F\begin{cases}(M1+M2)x-(M1*L4)\theta 1-(M2*L5)\theta_2+\\(C1+C2)\dot{x}-(C1*L1+C2*L2)\dot{\theta}1+\\(K1+K2)x-(K1*L1+K2*L2)\theta 1+\\For+AK1*Y+AK2*Z=0.0\end{cases}$$

$$\Sigma M1\begin{cases}(-M1*L4)x+(J1+M1*L4^2)\theta 1-\\(C1\cdot\times L1+C2*L2)\dot{X}+(C1*L1^2+C2*L2^2+\\C3*L3^2)\dot{\theta}1-(C3*L3^2)\dot{\theta}2(K1*L1+K2*L2)X+\\(K1*L1^2+K2*L2^2+K3*L3^2)\theta 1-(K3*L3^2)\theta 2+\\TOR-(K1*Y*L1+K2*Z*L2)=0.0\end{cases}$$

$$\Sigma M2\begin{cases}(-M2*L5)x+(J2+M2*L5^2)\theta 2-\\(C3*L3^2)\dot{\theta}1+(C3*L3^2)\dot{\theta}2\\(-K3*L3^2)\theta 1+(K3*L3^2)\theta 2=0.0\end{cases}$$

In a typical case involving a mobile crane of specific size and weight and having the input variables listed below, solution of the equations by the Jacobi method resulted in derivation of Eigen values representing three frequencies of vibration and Eigen vectors defining three modes of vibration. The three frequencies Nos. 1, 2 and 3 shown below pertain to the vertical deflection X, and angular deflections O1 and O2 FIG. 4. The matrixes A and B specified below are to be understood to be intermediate steps in deriving the Eigen values and vectors. The node locations specified below signify a point at that distance from the boom pivot at which rotation about the point but no vertical translation would occur.

The input variables AK1, AK2, AK3, AL1, AL2, AL3, AL4, AL5, AM1, AJ1, AM2, AJ2, respectively, are:

| | | | | | |
|---|---|---|---|---|---|
| 132000.00 | 132000.00 | 200000.00 | 11.5000 | 1.0800 | 4,6000 |
| 3,6300 | 14,5800 | 1240.90 | 74543.00 | 388.90 | 34481.00 |

The following is the defined Matrix A:

| | | |
|---|---|---|
| 264000.0000 | −1660560.0000 | 0.0 |
| −1660560.0000 | 21842964.8000 | −4232000.0000 |
| 0.0 | −4232000.0000 | 4232000.0000 |

The following is the defined Matrix B:

| | | |
|---|---|---|
| 1629.8000 | −4504.4670 | −5670.1620 |
| −4504.4670 | 90894.2152 | 0.0 |
| −5670.1620 | 0.0 | 117151.9620 |

Frequency No. 1 is 1,5322 HZ
The Eigen Vector is 0.9768 0.0957 0.0164
The Machine Node Location is 10.211
The Boom Node Location is 59.618
The Amplitude Ratio Thetal/Theta2 is 5.839
Frequency No. 2 is 2.6845 HZ
The Eigen Vector is −4.7572 0.8560 −0.3882
The Machine Node Location is −5.557
The Boom Node Location is 12.557
The Amplitude Ratio Thetal/Theta2 is −2.205
Frequency No. 3 is 0.7984 HZ
The Eigen Vector is 1.9159 0.2686 1.0030
The Machine Node Location s 5.197
The Boom Node Location is 1.910
The Amplitude Ratio Thetal/Theta2 is 0.368

Figure 11:
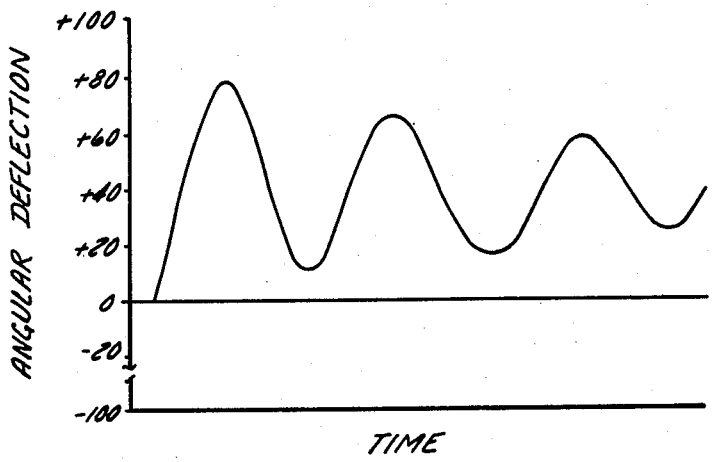
FIG. 11 is a graph depicting the typical oscillation or angular deflection of a chassis in a crane not employing a deflection reduction system in accordance with the invention.
Figure 12:
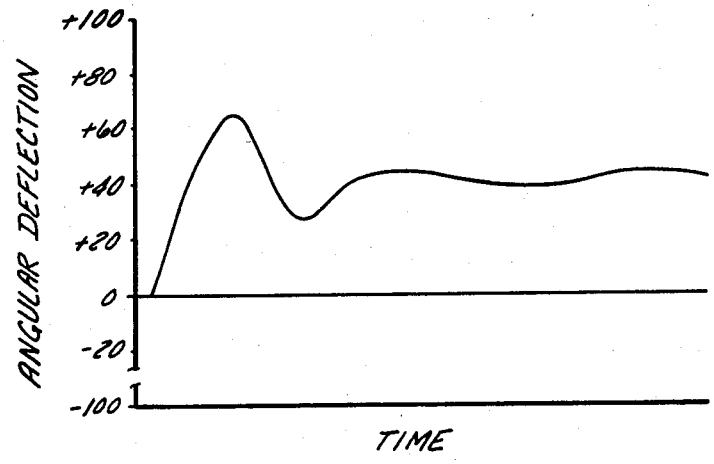
FIG. 12 is a graph depicting the typical oscillation effect of dynamic stabilization means in accordance with the invention.

Referring to FIGS. 11 and 12, there are shown graphs which exemplify, in FIG. 11, a mode or oscillation that occurs in a mobile crane not embodying the present invention and, in FIG. 12, a highly attenuated oscillation that results in a mobile crane which does embody the present invention. In applicant's system, generated modes of oscillation employ the phase difference between chassis and boom rotation effect reduction of bounce and porpoising.

I claim:

1. A deflection reduction module for mechanical and hydraulic connection to a boom hoist cylinder which is connected between the chassis of a vehicle and a boom pivotably mounted on said chassis, comprising:
   - a gas barrel for containing gas;
   - a gas piston slidably mounted in said gas barrel and adapted to be biased in one direction by said gas acting thereon;
   - a hydraulic fluid barrel;
   - a hydraulic fluid piston slidably mounted in said hydraulic fluid barrel;
   - said hydraulic fluid barrel having a hydraulic fluid port therein for ingress and egress of hydraulic fluid from said boom hoist cylinder;
   - means for connecting said gas piston and said hydraulic fluid piston so that the pistons move in unison;
   - and a spring for biasing said pistons in said one direction;
   - said module being operable so that ingress and egress of hydraulic fluid through said port into and out of said hydraulic fluid barrel from said boom hoist cylinder effects compression and expansion, respectively, of said spring and said gas.

2. A module according to claim 1 wherein said hydraulic fluid piston is of smaller area than said gas piston.

3. A module according to claim 2 wherein said barrels are embodied in a common housing in axial alignment with each other.

4. A module according to claim 3 wherein said spring is disposed in said gas barrel between said gas piston and a portion of said housing.

5. A module according to claim 4 wherein said spring is a helical compression spring and including a spring support member connected to and extending from said gas piston and around which said spring is disposed.

6. A module according to claim 1 or 2 or 3 or 4 further including valve means for controlling fluid flow to and from said port.

7. A deflection reduction module for mechanical and hydraulic connection to a boom hoist cylinder which is connected between a vehicle chassis and a boom pivotally mounted on said chassis, comprising:
   - a housing comprising a hydraulic fluid chamber and a gas chamber,
   - said gas chamber having a transverse cross-sectional area larger than said hydraulic fluid chamber,
   - said housing having a fluid inlet/outlet port communicating with said hydraulic fluid chamber;
   - a piston assembly mounted in said housing and comprising a hydraulic fluid piston slidably mounted in said hydraulic fluid chamber and a gas piston slidably mounted in said gas chamber and connected to and movable with said hydraulic fluid piston,
   - said gas piston having an area larger than said hydraulic fluid piston;
   - a helical compression spring mounted in said gas chamber between said gas piston and a portion of said housing near an end of said gas chamber;
   - and a spring support member in said gas chamber connected to and extending from said gas piston and around which said spring is disposed.

8. A module according to claim 7 wherein said piston assembly comprises a piston rod extending between and into both chambers and connected to both pistons, said piston rod having a hollow interior space which is in communication with said gas chamber but sealed from said hydraulic fluid chamber.

9. A module according to claim 8 wherein said spring support member is a hollow tubular member open at both ends and through which said space in said piston rod communicates with said gas chamber.

10. A module according to claim 9 wherein said housing comprises sealable port means for filling said gas chamber with gas.

11. A module according to claim 7 or 8 or 9 or 10 further including valve means mounted on said housing for controlling hydraulic fluid flow through said inlet/-outlet port.

12. A deflection reduction system for use with a double-acting boom hoist cylinder having opposite ends separated by a boom hoist piston and connected between a boom and a vehicle chassis on which the boom is pivotably mounted, said chassis being deflectable relative to terrain over which the vehicle travels and said boom being deflectable relative to said chassis while said vehicle is in motion, said system comprising:

a deflection reduction module for mounting on said boom hoist cylinder and comprising a hydraulic fluid barrel having a hydraulic fluid piston therein, a gas barrel having a gas piston and compressed gas therein for biasing said gas piston in one direction, said pistons being interconnected so that they are movable in unison, and a spring for biasing said pistons in said one direction;

and valve means selectively operable to interconnect said opposite ends of said boom hoist cylinder in a closed circuit and to connect said closed circuit to said hydraulic fluid barrel.

13. A system according to claim 12 wherein said valve means comprises a selectively operable valve having one position wherein it enables hydraulic fluid flow in both directions between said closed circuit and said hydraulic fluid barrel and having another position wherein it prevents hydraulic fluid flow to said hydraulic fluid barrel but permits hydraulic fluid flow from said hydraulic fluid barrel.

14. A system according to claim 12 or 13 wherein said valve means further comprises another selectively operable valve having one position wherein it effects establishment of said closed circuit and another position wherein it dis-establishes said closed circuit.

15. A system according to claim 14 wherein said valves are operated so that both assume the said one position at the same time and so that both assume the said other position at the same time.

16. A system according to claim 15 wherein said valves are solenoid valves which operate substantially simultaneously.

17. In a mobile machine:

a vehicle chassis deflectable relative to terrain over which it travels;

a load-handling boom pivotably mounted on said chassis and deflectable relative to said chassis;

a double-acting boom hoist cylinder for raising and lowering said boom and connected between said chassis and said boom, said boom hoist cylinder comprising a boom hoist cylinder housing, a boom hoist piston slidably mounted in said housing and dividing said housing into two chambers on opposite sides of said boom hoist piston, and a boom hoist piston rod connected to said boom hoist piston;

means for operating said boom hoist cylinder comprising a source of hydraulic fluid, a selectively operable boom hoist control valve connected to said source and operable to extend and retract said boom hoist cylinder, a holding valve operable to maintain said boom hoist cylinder in a raised position;

and a deflection reduction system for preventing deflection of said chassis and responsive to deflection of said boom and comprising:

a deflection reduction module for mounting on said boom hoist cylinder and comprising a hydraulic fluid cylinder having a hydraulic fluid piston therein, a gas cylinder having a gas piston and compressed gas therein for biasing said gas piston in one direction, said pistons being interconnected so that they are movable in unison, and a spring for biasing said pistons in said one direction;

and valve means selectively operable to by-pass said boom hoist control valve and said holding valve and to interconnect said two chambers of said boom hoist cylinder in a closed circuit and to connect said closed circuit to said hydraulic fluid cylinder.

18. A mobile machine according to claim 17 wherein said valve means comprises a selectively operable valve having one position wherein it enables hydraulic fluid flow in both directions between said closed circuit and said hydraulic fluid cylinder and having another position wherein it prevents hydraulic fluid flow to said hydraulic fluid cylinder but permits hydraulic fluid flow from said hydraulic fluid cylinder.

19. A mobile machine according to claim 17 or 18 wherein said valve means further comprises another selectively operable valve having one position wherein it effects establishment of said closed circuit and another position wherein it dis-establishes said closed circuit.

20. A mobile machine according to claim 19 wherein said selectively operable valves are operated so that both assume the said one position at the same time and so that both assume the said other position at the same time.

21. A mobile machine according to claim 20 wherein said selectively operable valves are solenoid valves which operate substantially simultaneously.

22. A mobile machine according to claim 19 further including a shuttle valve responsive to said other selectively operable valve to aid in establishing and dis-establishing said closed circuit.

* * * * *